US009318816B2

(12) United States Patent
Osaka

(10) Patent No.: US 9,318,816 B2
(45) Date of Patent: Apr. 19, 2016

(54) ELECTRIC CONNECTOR AND TERMINAL INCLUDED IN THE SAME

(71) Applicant: DAI-ICHI SEIKO CO., LTD., Kyoto (JP)

(72) Inventor: Junji Osaka, Tokyo (JP)

(73) Assignee: DAI-ICHI SEIKO CO., LTD., Kyoto (JP)

( * ) Notice: Subject to any disclaimer, the term of this patent is extended or adjusted under 35 U.S.C. 154(b) by 0 days.

(21) Appl. No.: 14/505,710

(22) Filed: Oct. 3, 2014

(65) Prior Publication Data

US 2015/0104975 A1 Apr. 16, 2015

(30) Foreign Application Priority Data

Oct. 15, 2013 (JP) ..... 2013-214959

(51) Int. Cl.
*H01R 4/24* (2006.01)

(52) U.S. Cl.
CPC ..... *H01R 4/2454* (2013.01)

(58) Field of Classification Search
CPC ..... H01R 4/2454
See application file for complete search history.

(56) References Cited

U.S. PATENT DOCUMENTS

| | | | | | |
|---|---|---|---|---|---|
| 3,824,530 | A * | 7/1974 | Roberts et al. | | 439/398 |
| 4,097,107 | A * | 6/1978 | Hawkins | | 439/397 |
| 4,118,103 | A * | 10/1978 | Leidy et al. | | 439/398 |
| 4,220,390 | A * | 9/1980 | Cobaugh et al. | | 439/401 |
| 5,562,478 | A * | 10/1996 | Yamamoto | | 439/402 |
| 5,588,859 | A * | 12/1996 | Maurice | | 439/290 |
| 5,669,778 | A * | 9/1997 | Kramer | H01R 4/2445 | 439/398 |
| 5,769,654 | A * | 6/1998 | Onoda | | 439/393 |
| 5,906,502 | A * | 5/1999 | Fasano | | 439/395 |
| 7,134,903 | B1 * | 11/2006 | Pavlovic | | 439/404 |
| 7,326,069 | B1 * | 2/2008 | Duesterhoeft et al. | | 439/92 |
| 8,083,538 | B2 * | 12/2011 | Ofenloch et al. | | 439/404 |
| 2015/0104975 | A1 * | 4/2015 | Osaka | | 439/578 |

FOREIGN PATENT DOCUMENTS

| | | |
|---|---|---|
| JP | 5-69859 | 9/1993 |
| JP | 5-335037 | 12/1993 |
| JP | 6-77470 | 9/1994 |
| JP | 8-17484 | 1/1996 |
| JP | 2681430 | 8/1997 |
| JP | 2000-195576 | 7/2000 |
| JP | 2005-332632 | 12/2005 |
| JP | 2007-48696 | 2/2007 |
| KR | 1995-0007209 | 9/1995 |

* cited by examiner

*Primary Examiner* — James Harvey
(74) *Attorney, Agent, or Firm* — Wenderoth, Lind & Ponack, L.L.P.

(57) ABSTRACT

There is provided a terminal made of a single metal sheet, the terminal including a support unit in which a core wire of a cable is sandwiched, the support unit including a first portion extensive in a direction perpendicular to a direction in which an axis of the core wire extends, and a second portion spaced away from the first portion, and extensive in a direction perpendicular to a direction in which the axis of the core wire extends, the first and second portions being connected at an end thereof to each other, the first and second portions being formed with a slit thereover, a center line of the slit existing in the first portion and a center line of the slit existing in the second portion deviating from each other when viewed in a direction in which the axis of the core wire extends.

11 Claims, 16 Drawing Sheets

ELECTRIC CONNECTOR AND TERMINAL INCLUDED IN THE SAME

BACKGROUND OF THE INVENTION

1. Field of the Invention

The invention relates to an electric connector making mechanical and electrical contact with a core wire of a cable, and further to a terminal included in the electric connector.

2. Description of the Related Art

A coaxial cable includes a central electrical conductor as a core wire, an internal electrical insulator covering therewith the central electrical conductor, and an external electrical conductor comprised of a mesh wire, for instance, and surrounding the internal electrical insulator. The central electrical conductor and the external electrical conductor act as wires through which electric signals are transmitted. As an electric connector to be electrically connected to such a coaxial cable, various electric connectors have been suggested as follows.

FIG. 12 illustrates a connector 1100 used for a coaxial cable, suggested in Japanese Patent Application Publication No. 2005-332632.

In the connector 1100, when a cover housing 1101 is coupled to a main housing 1102, an external insulative cover, an external electrical conductor, and an internal insulative cover of a coaxial cable 1105 are cut in this order by a blade 1104 arranged in a slot 1103 to thereby cause the blade 1104 to make contact with the internal electrical conductor. Concurrently, a ground contact 1106 formed at the cover housing 101 is caused to make contact with the external electrical conductor.

In the connector 1100, a compressive force generated when a pair of compressing parts 1107 formed at the cover housing 1101 compresses the coaxial cable 1105 onto an inclining cam surface 1108 is converted into a force by which the coaxial cable is pulled in opposite directions about the blade 1104. Thus, in such a condition that the blade 1104 is caused to make compressive contact with the internal electrical conductor of the coaxial cable 1105, the external electrical conductor is torn in opposite directions about a projection 1109 formed at the main housing 1102. The blade 1104 is prevented from making contact with the external electrical conductor, because the projection 1109 acts as a wall. Thus, it is possible to cause the blade 1104 to surely make contact only with the internal electrical conductor.

FIGS. 13A to 13D illustrate a contact 1000 to which a cable is connected, as suggested in Japanese Patent Application Publication No. 2007-48696.

The contact 1000 has a V-shaped slit 1001 (see FIG. 13A). Portions defining the V-shaped slit 1001 or located sandwiching the V-shaped slit 1001 are used as compression terminals 1002. A punch 1004 formed with wavy grooves 1003 is compressed onto the contact 1000 to thereby collapse the portions towards the slit 1001, as illustrated in FIG. 13C, resulting in that core wires (central electrical conductors) 1006 of a cable 1005 are sandwiched between the portions.

FIGS. 14A to 14C illustrate a contact 1008 to which a cable is connected, as suggested in Japanese Patent Application Publication No. 2007-48696, as another embodiment.

In the illustrated embodiment, one of the compression terminals 1007A is bent towards the other compression terminal 1007B, and the compression terminal 1007B is bent towards the compression terminal 1007A such that their distal ends do not interfere with each other. Thus, the contact 1008 is completed.

In the connector 1100 illustrated in FIG. 12, an external insulative cover, an external electrical conductor, and an internal insulative cover of the coaxial cable 1105 are cut in this order by the blade 1104 to thereby cause the blade 1004 to make contact with the internal electrical conductor. Accordingly, when the cover housing 1101 is coupled to the main housing 1102, the internal electrical conductor may be accidentally damaged or cut by the blade 1104. In particular, since a recent coaxial cable is designed to have a small diameter, if the internal electrical conductor were damaged or cut, the reliability to electrical contact between the coaxial cable 1105 and the connector 1100 would be deteriorated. Furthermore, if the internal insulative cover were adhered to the blade 1104 and were put into the internal electrical conductor together with the blade 1104 when the internal insulative cover is cut by the blade 1104, a defect in the electrical connection would be caused.

For the purpose of avoiding the above-mentioned problem, the contact 1000 illustrated in FIGS. 13A to 13D is designed to make electrical contact with the central electrical conductors 1006 arranged naked by peeling off the external and internal insulative covers. In the contact 1000, the central electrical conductors 1006 are sandwiched in the slit 1001 by closing the V-shaped slit 1001 to thereby cause the contact 1000 and the cable 1005 to make compressive contact with each other. Thus, if the central electrical conductors 1006 are comprised of a bundle of thin wires, the thin wires could not be kept bundled, resulting in deterioration in reliability to the electrical connection between the cable 1005 and the contact 1000.

The contact 1008 illustrated in FIGS. 14A to 14C provides an advantage that since the compression terminals 1007A and 1007B are bent such that their distal ends do not interfere with each other, a space in which the central electrical conductors are housed can have a small diameter, ensuring that the central electrical conductors can be surely kept in the space. However, when the slit 1009 is closed, the compression terminals 1007A and 1007B exert a shearing stress on the central electrical conductors, as if something is cut by a pair of scissors, resulting in that the central electrical conductors may be accidentally cut by the compression terminals 1007A and 1007B.

SUMMARY OF THE INVENTION

In view of the above-mentioned problems in the conventional connectors, it is an object of the present invention to provide an electric connector capable of surely holding core wires even if the core wires were comprised of a bundle of thin wires, and enhancing the reliability of electrical connection between the electric connector and the core wires.

It is another object of the present invention to provide an electric terminal used in the above-mentioned electric connector.

In one aspect of the present invention, there is provided a terminal made of a single metal sheet, the terminal including a support unit in which a core wire of a cable is sandwiched. The support unit includes a first portion extensive in a direction perpendicular to a direction in which an axis of the core wire extends, and a second portion spaced away from the first portion, and extending in a direction perpendicular to a direction in which the axis of the core wire extends. The first and second portions are connected at an end thereof to each other, and the first and second portions are formed with a slit thereover, a center line of the slit existing in the first portion and a center line of the slit existing in the second portion deviating from each other when viewed in a direction in which the axis of the core wire extends.

For instance, a position of the slit existing in the first portion relative to the first portion and a position of the slit existing in the second portion relative to the second portion are identical with each other, and the first and second portions deviate from each other in position when viewed in a direction in which the axis of the core wire extends.

It is preferable that the terminal further includes a third portion inclined relative to the axis of the core wire, the first and second portions being connected to each other through the third portion.

For instance, a position of the slit existing in the first portion relative to the first portion and a position of the slit existing in the second portion relative to the second portion are different from each other to thereby cause the center lines to deviate from each other when viewed in a direction in which the axis of the core wire extends.

It is preferable that the slit existing in the first portion and the slit existing in the second portion are V-shaped or U-shaped at an end at which the first and second portions are connected to each other.

It is preferable that the slit existing in the first portion and the slit existing in the second portion have a width smaller than a width of the core wire.

It is preferable that the terminal further includes a terminal part in the form of a plate, the terminal plate extending from the other end of the first or second portion in a direction in which the axis of the core wire extends.

It is preferable that the first and second portions are U-shaped when viewed in a direction perpendicular to a direction in which the axis of the core wire extends.

In another aspect of the present invention, an electric connector includes a first terminal comprised of the above-mentioned terminal, and a housing including a second support and a third support. The second and third supports are spaced away from each other in a direction in which the axis of the core wire extends, and the second support supports the cable at one side of the cable and the third support supports the cable at the other side of the cable in a direction perpendicular to a direction in which the axis of the core wire extends.

When the cable is comprised of a coaxial cable, it is preferable that the first terminal supports and makes electrical contact with a core wire or a central electrical conductor of the cable, and the second and third supports support the cable through an external electrical conductor surrounding an internal electrical insulator covering therewith the central electrical conductor of the cable.

It is preferable that the electric connector further includes a cable space in which the cable is accommodated, the cable space being located at the opposite side relative to the second and third supports about the first terminal, the cable space having a center line extending in a direction in which the axis of the core wire extends, the center line being deviated from the axis of the core wire.

The advantages obtained by the aforementioned present invention will be described hereinbelow.

The electric connector and the terminal included in the electric connector both in accordance with the present invention are capable of surely holding core wires even if the core wires were comprised of a bundle of thin wires, and further, enhancing the reliability to electrical connection between the electric connector and the core wires.

The above and other objects and advantageous features of the present invention will be made apparent from the following description made with reference to the accompanying drawings, in which like reference characters designate the same or similar parts throughout the drawings.

DESCRIPTION OF THE PREFERRED EMBODIMENTS

First Embodiment

Figure 1:
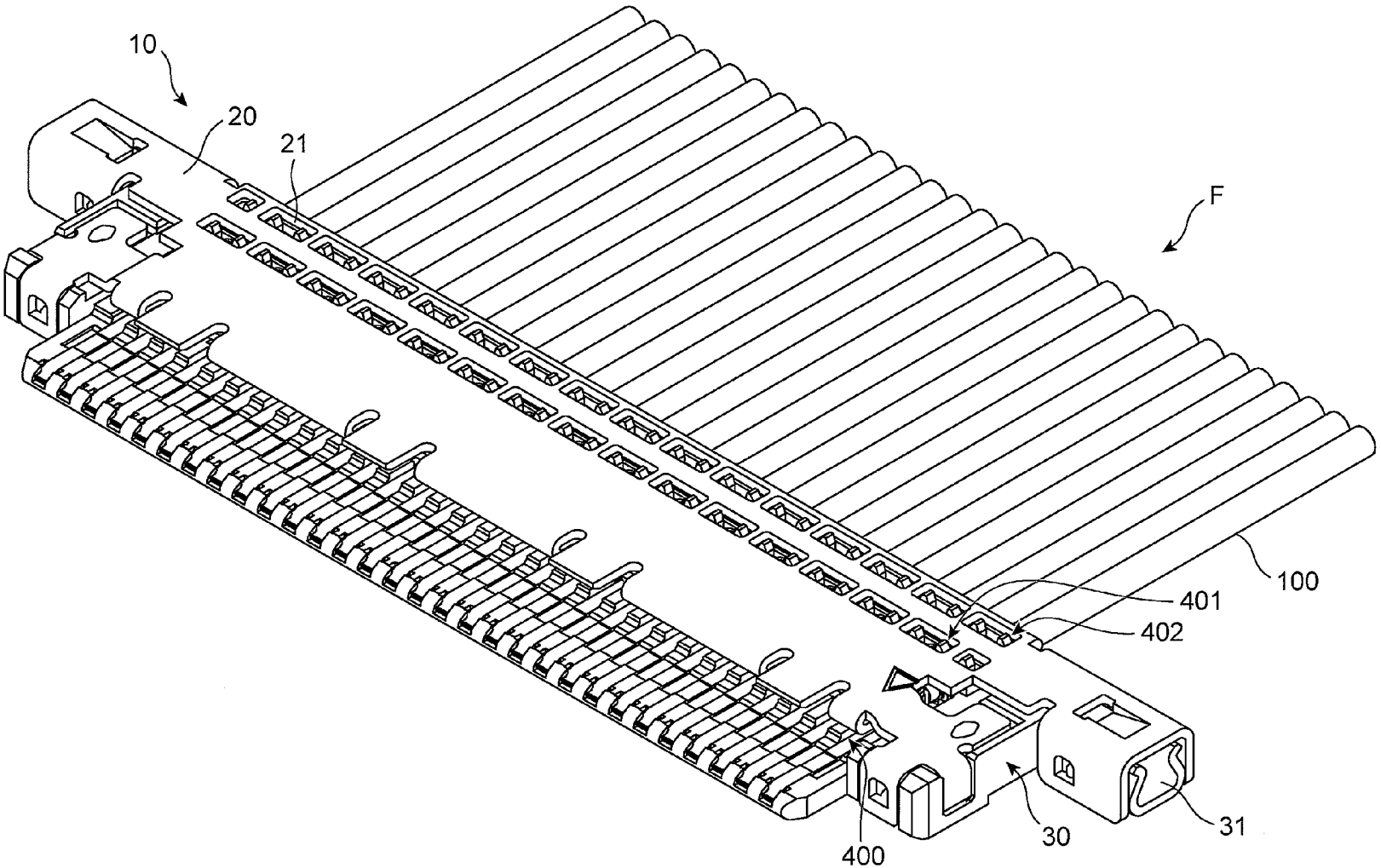
FIG. 1 is a perspective view of the electric connector in accordance with the first embodiment of the present invention.

FIG. 1 illustrates an electric connector 10 in accordance with the first embodiment of the present invention. The electric connector 10 is electrically connected to a plurality of coaxial cables 100 (see FIG. 6), for instance. The electric connector 10 may be employed for a liquid crystal display (LCD), for instance.

The electric connector 10 includes a cover 20 made of a metal, a housing 30, and a plurality of first terminals 400. The cover 20 is coupled to the housing 30 so as to cover the housing 30. The cover 20 is formed with a plurality of openings 21 to be engaged with a later-mentioned second support 401 and a later-mentioned third support 402 when the cover 20 is coupled to the housing 30. As illustrated in FIG. 1, the openings 21 are arranged in zigzag in two rows.

Figure 2:
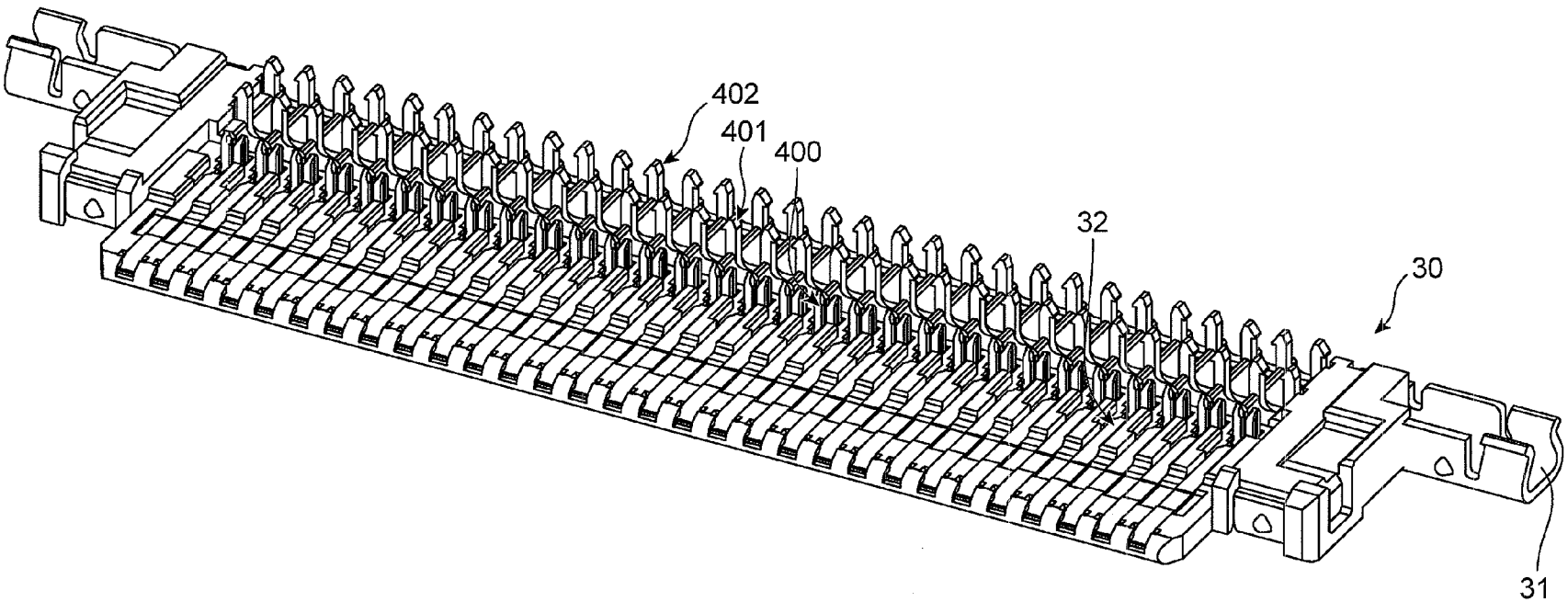
FIG. 2 is a perspective view of the housing and the terminals.

The housing 30 is designed to include at opposite ends thereof arms 31 for fixing the cover 20 to the housing 30. As illustrated in FIG. 2, the housing 30 is formed with a plurality of cable spaces 32 into each of which a coaxial cable 100 is inserted. Each of the cable spaces 32 is in the form of a groove. The cable spaces 32 are arranged in a line in a lengthwise direction of the housing 30.

Figure 3:
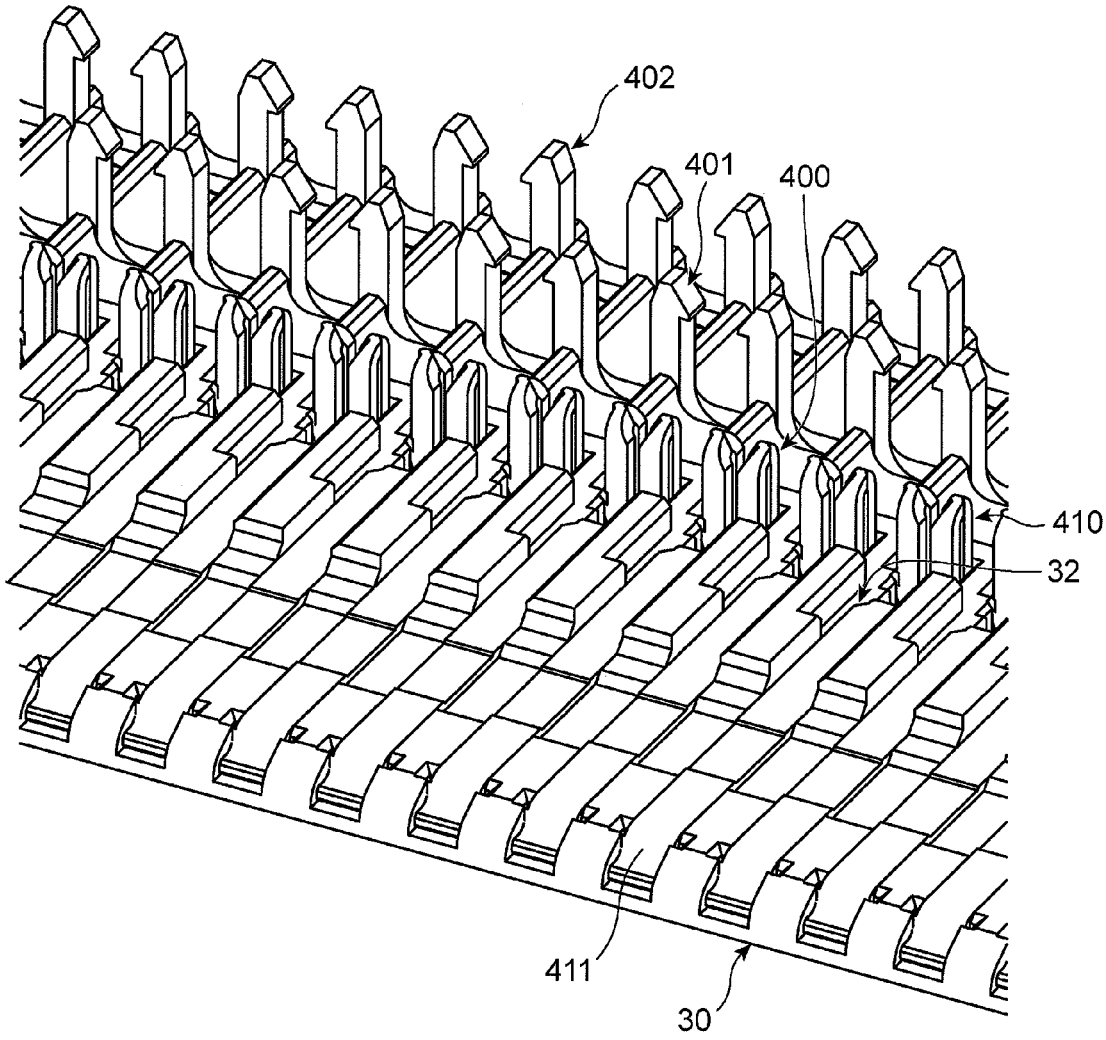
FIG. 3 is a partially enlarged view of FIG. 2.

As illustrated in FIG. 3, each of the cable spaces 32 includes a second support 401 and a third support 402, and the above-mentioned first terminal 400 is inserted into each of the cable spaces 32. The first terminal 400 makes mechanical and electrical contact with a central electrical conductor (i.e., core wire) 114 of the coaxial cable 100, and the second and third supports 401 and 402 make mechanical contact with an external electrical conductor 112 of the coaxial cable 100 to thereby support the coaxial cable 100.

The first terminal 400 is explained hereinbelow with reference to FIGS. 4A to 4F.

The first terminal 400 is fabricated from a single metal sheet, and includes a support unit 410 in which the central electrical conductors 114 of the coaxial cable 100 is sandwiched, and a terminal portion 411 extending from a lower end of the support unit 410 in a direction away from the support unit 411, and designed to make electrical contact with another electric connector (not illustrated).

The support unit 410 includes a first portion 420, a second portion 430, and a third portion 440 located between the first portion 420 and the second portion 430. The first and second portions 420 and 430 cooperate with each other to sandwich the central electrical conductor 114 therebetween.

The first portion 420 extends in a plane substantially perpendicular to a direction in which the central electrical conductor (core wire) 114 of the coaxial cable 110 extends (that is, a direction in which the terminal portion 411 extends). The second portion 430 is spaced away from the first portion 420, and, similarly to the first portion 420, extends in a plane substantially perpendicular to a direction in which the central electrical conductor (core wire) 114 of the coaxial cable 110 extends.

The first portion 420 is connected at an end (an upper end in FIG. 4C) to an end (an upper end in FIG. 4C) of the second portion 430 through the third portion 440. As illustrated in FIG. 4C, the first portion 420 and the second portion 430 are reverse U-shaped as an entirety thereof.

Specifically, the first portion 420 is connected at an end (an upper end in FIG. 4C) to an end (an upper end in FIG. 4C) of the second portion 430 through the third portion 440, and is free at the other end (a lower end). The second portion 430 is connected at the other end (a lower end in FIG. 4C) to an end of the terminal portion 411. The terminal portion 411 is free at the other end.

Figure 4A:
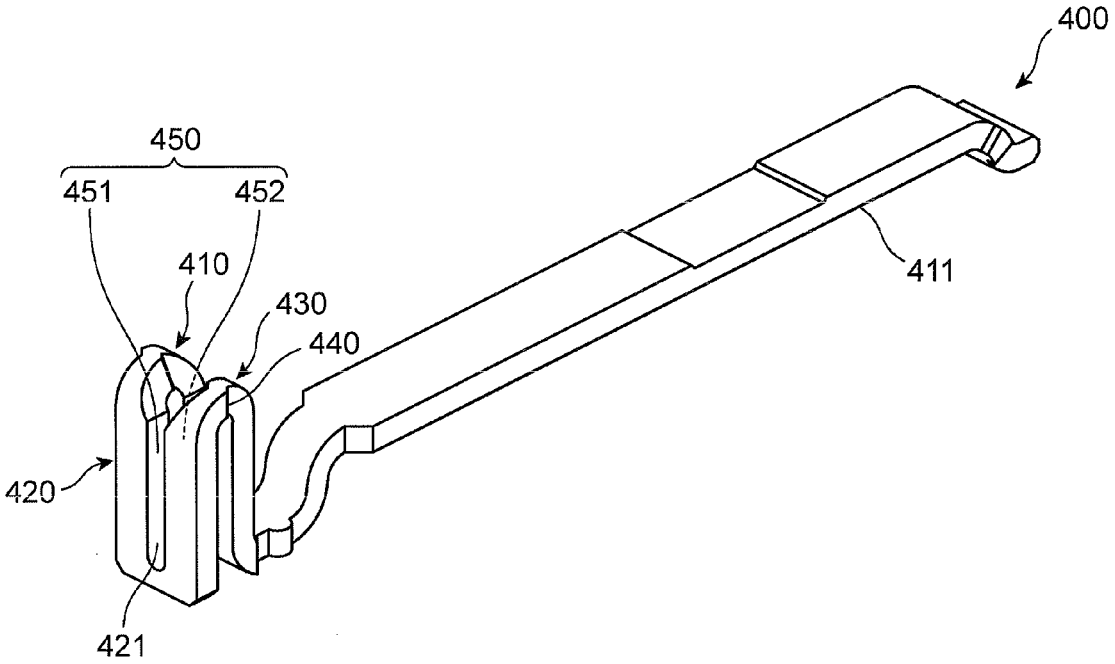
FIG. 4A is a perspective view of the first terminal.
Figure 4B:
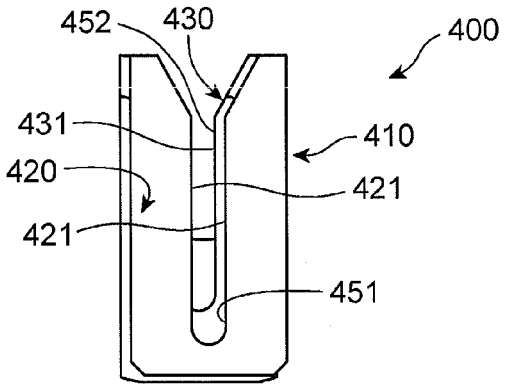
FIG. 4B is a front view of the first terminal.
Figure 4C:
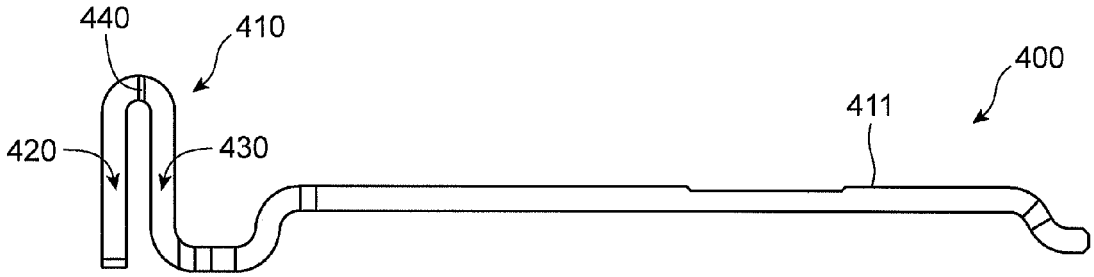
FIG. 4C is a right side view of the first terminal.
Figure 4D:
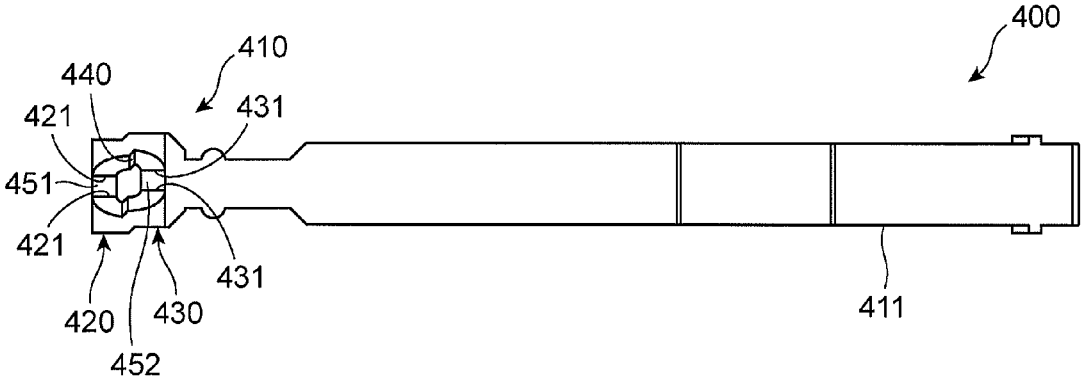
FIG. 4D a plan view of the first terminal.

As illustrated in FIGS. 4A, 4B and 4D, the first portion 420 and the second portion 430 are formed thereacross substantially at a center thereof with a slit 450. Hereinbelow, a portion of the slit 450 which exists in the first portion 420 is referred to as a first slit 451, and a portion of the slit 450 which exists in the second portion 430 is referred to as a second slit 452.

The first slit 451 has a pair of contact surfaces 421 facing each other, between which the central electrical conductor 114 of the coaxial cable 100 is sandwiched. Similarly, the second slit 452 has a pair of contact surfaces 431 facing each other, between which the central electrical conductor 114 of the coaxial cable 100 is sandwiched.

A width of the first slit 451 (that is, a distance between the contact surfaces 421) and a width of the second slit 452 (that is, a distance between the contact surfaces 431) are designed to be smaller than an outer diameter of the central electrical conductor 114.

As illustrated in FIGS. 4A, 4B, 4D and 4E, when viewed in a direction of an axis of the central electrical conductor 114 of the coaxial cable 100, a center line of the first slit 451 and a center line of the second slit 452 are not coincident with each other, that is, they deviate from each other.

Specifically, a position of the first slit 451 relative to the first portion 420 and a position of the second slit 452 relative to the second portion 430 are identical with each other. However, when viewed in a direction of an axis of the central electrical conductor 114 of the coaxial cable 100, the first portion 420 and the second portion 430 deviate in position (i.e., are offset) from each other. Thus, a center line of the first slit 451 and a center line of the second slit 452 deviate (are offset) from each other.

This is because the third portion 440 exists between the first portion 420 and the second portion 430.

Figure 4E:
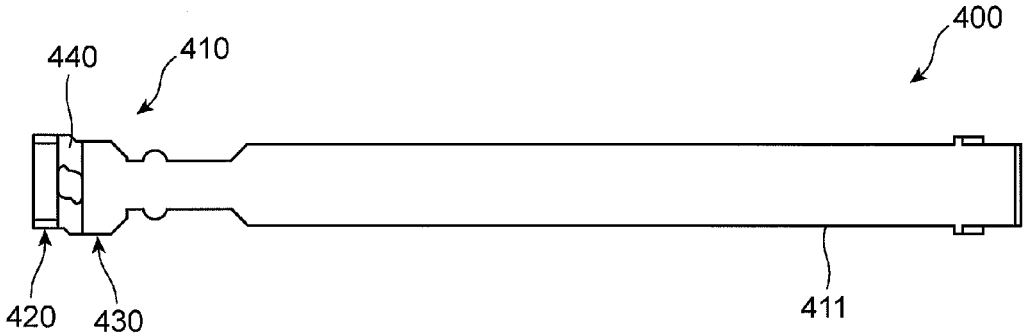
FIG. 4E is a bottom view of the first terminal.
Figure 5:
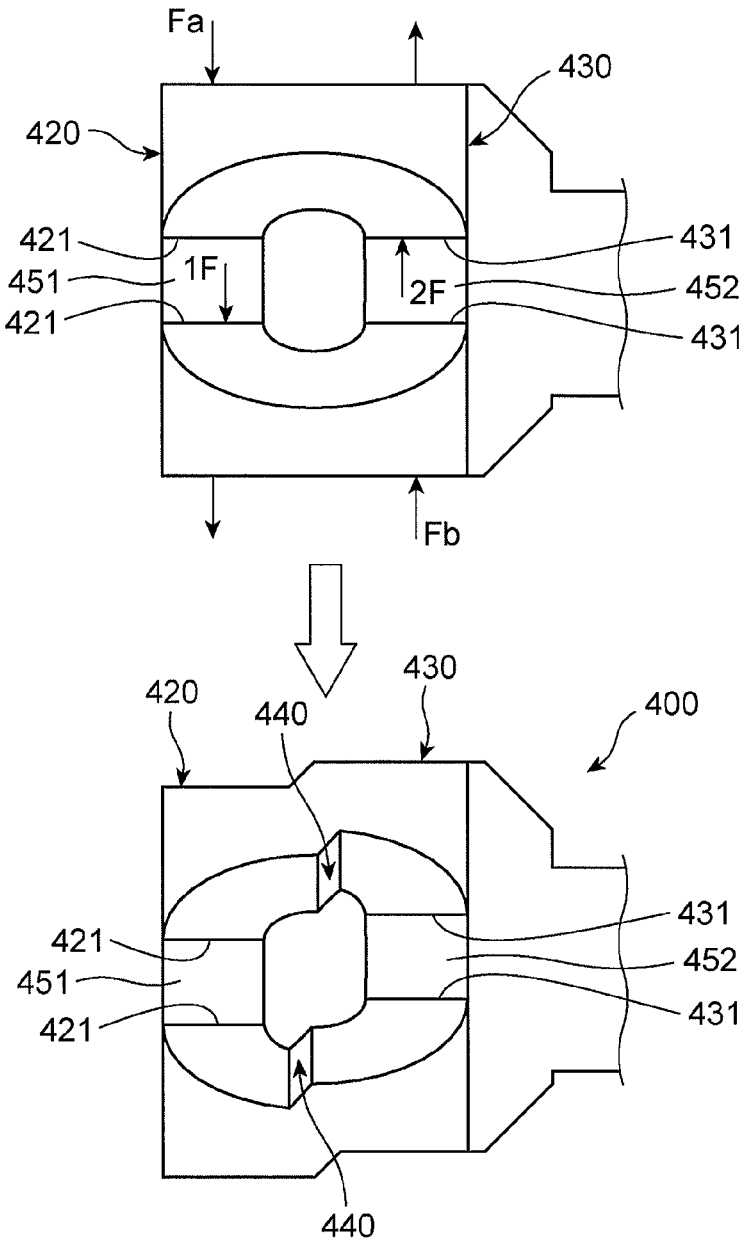
FIG. 5 is a partially enlarged view of the first terminal.
Figure 9:
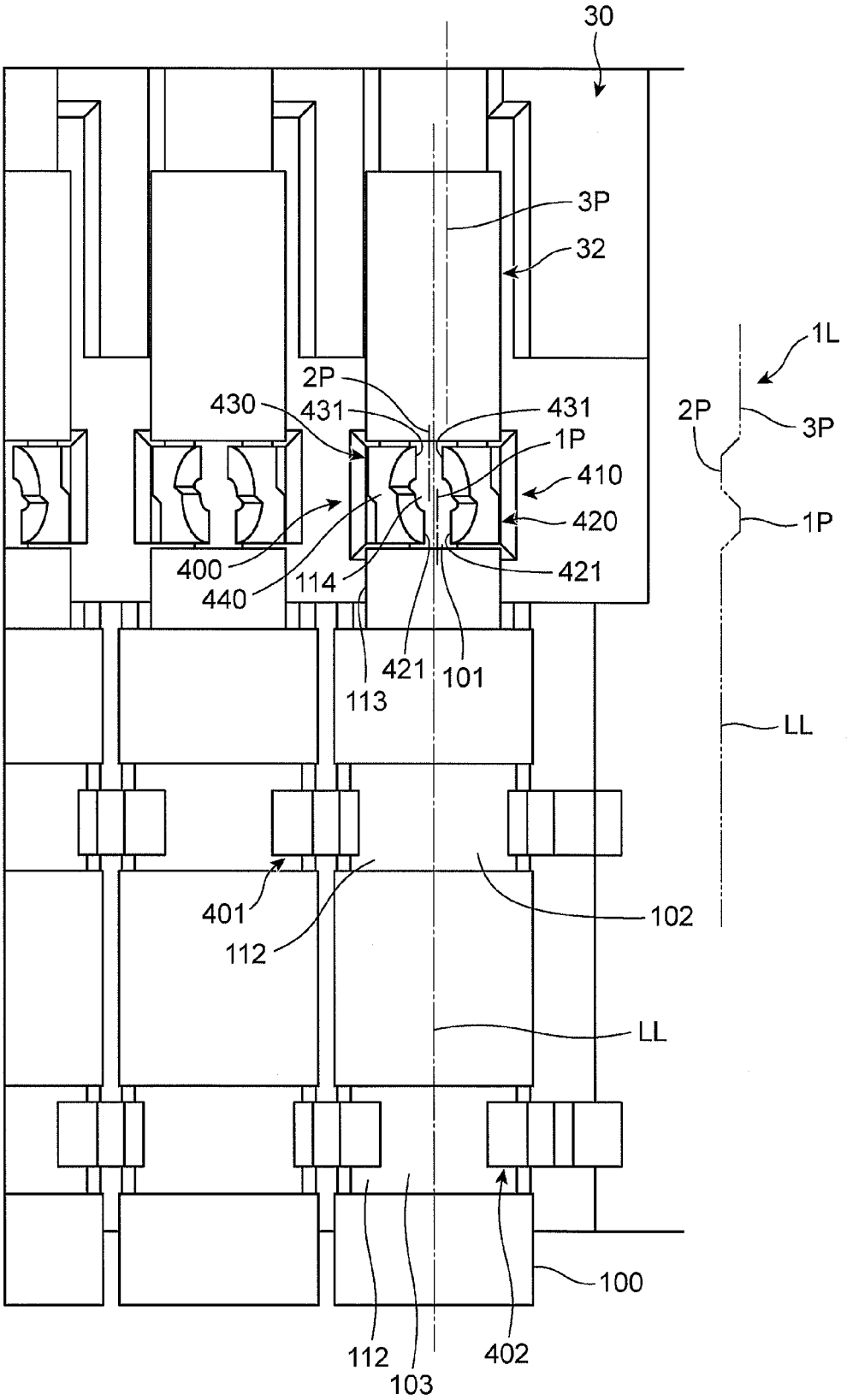
FIG. 9 is a plan view of the coaxial cables supported by the second and third supports.

As illustrated in FIGS. 4A, 4D and 4E, the third portion 440 is laterally inclined (or twisted) relative to a direction of an axis of the central electrical conductor (core wire) 114 of the coaxial cable 100. In other words, as also shown in FIGS. 5 and 9, the third portion 440 is inclined within a horizontal plane (the plane of FIGS. 5 and 9) relative to the longitudinal axis of the core wire 14. Consequently, the first and second portions 420 and 430 connected to each other through the third portion 440 are situated in deviation relative to each other.

FIG. 5 is a plan view of the first and second portions 420 and 430, showing a method of fabricating them.

As illustrated in FIG. 5, the first terminal 400 is fabricated by compressing the first portion 420 in a direction indicated by an arrow 1F and concurrently compressing the second portion 430 in a direction indicated by an arrow 2F, that is, a direction opposite to the direction indicated by the arrow 1F. Thus, the first portion 420 is entirely shifted to the direction 1F and the second portion 430 is entirely shifted to the direction 2F. As a result, a portion located between the first portion 420 and the second portion 430 is forced to be extended due to ductility of a metal of which the first terminal 400 is made, and thus, there is formed the third portion 440 between the first portion 420 and the second portion 430.

Thus, the first portion 420 and the second portion 430 which were located at the same position when viewed in a direction of an axis of the central electrical conductor 114 of the coaxial cable 100 are offset or shifted towards the opposite directions 1F and 2F. Consequently, a center line of the first slit 451 and a center line of the second slit 452 are deviated from each other.

The step of shifting the first portion 420 and the second portion 430 to the opposite directions 1F and 2F may be carried out at any time. For instance, the step can be carried out when the contact surfaces 421 and 431 face in a common direction, or when the contact surfaces 421 and 431 are caused to stand to face each other.

Figure 4F:
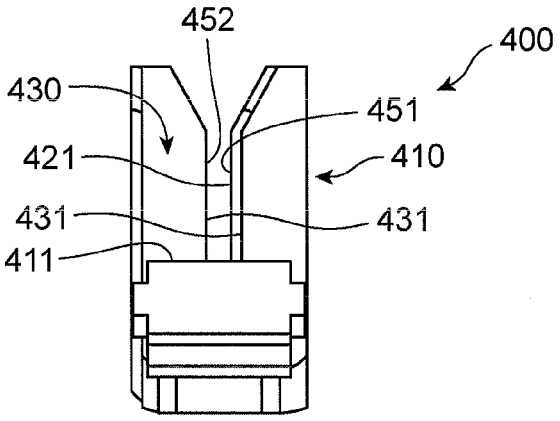
FIG. 4F is a rear view of the first terminal.

As illustrated in FIGS. 4B and 4F, the first slit 451 and the second slit 452 are designed to be V-shaped at a summit thereof. Specifically, a space between the contact surfaces 421 and 431 is greater at a location nearer to a summit (an upper end) of the support unit 410. As illustrated in FIG. 4B, the first portion 420 and the second portion 430 are U-shaped when viewed in a direction of an axis of the central electrical conductor 114 of the coaxial cable 100.

As illustrated in FIGS. 4A to 4C and 4E, the third portion 440 connects an upper end of the first portion 420 and an upper end of the second portion 430 to each other, and thus, is located between the first portion 420 and the second portion 430. Since the first portion 420 and the second portion 430 are deviated from each other when viewed in a direction of an axis of the central electrical conductor 114 of the coaxial cable 100, the third portion 440 is caused to be inclined relative to the axis of the central electrical conductor 114.

The terminal portion 411 is inserted into a groove of the cable space 32 (see FIG. 3) formed in the housing 30 to thereby make contact with an opposing contact when the electric connector 10 is connected to an opposing electric connector.

As illustrated in FIG. 3, the second support 401 and the third support 402 define a pair of hooks in order to sandwich the external electrical conductor 112 of the coaxial cable 100 therebetween. The second support 401 and the third support 402 are designed to be elastic. When the cover 20 is coupled to the housing 30, the openings 21 lower to inwardly push the hooks at distal ends thereof, and thus, the second support 401 and the third support 402 sandwich the external electrical conductor 112 therebetween. The second support 401 and the third support 402 are alternately located. Specifically, the second support 401 is located at a first location at which the second support 401 engages the external electrical conductor 112, and the third support 402 is located at a second position at which the third support 402 engages the external electrical conductor 112. The second position is remoter than the first position from the first terminal 400.

Hereinbelow is explained how the electric connector 10 in accordance with the first embodiment is used, with reference to the drawings.

Figure 6:
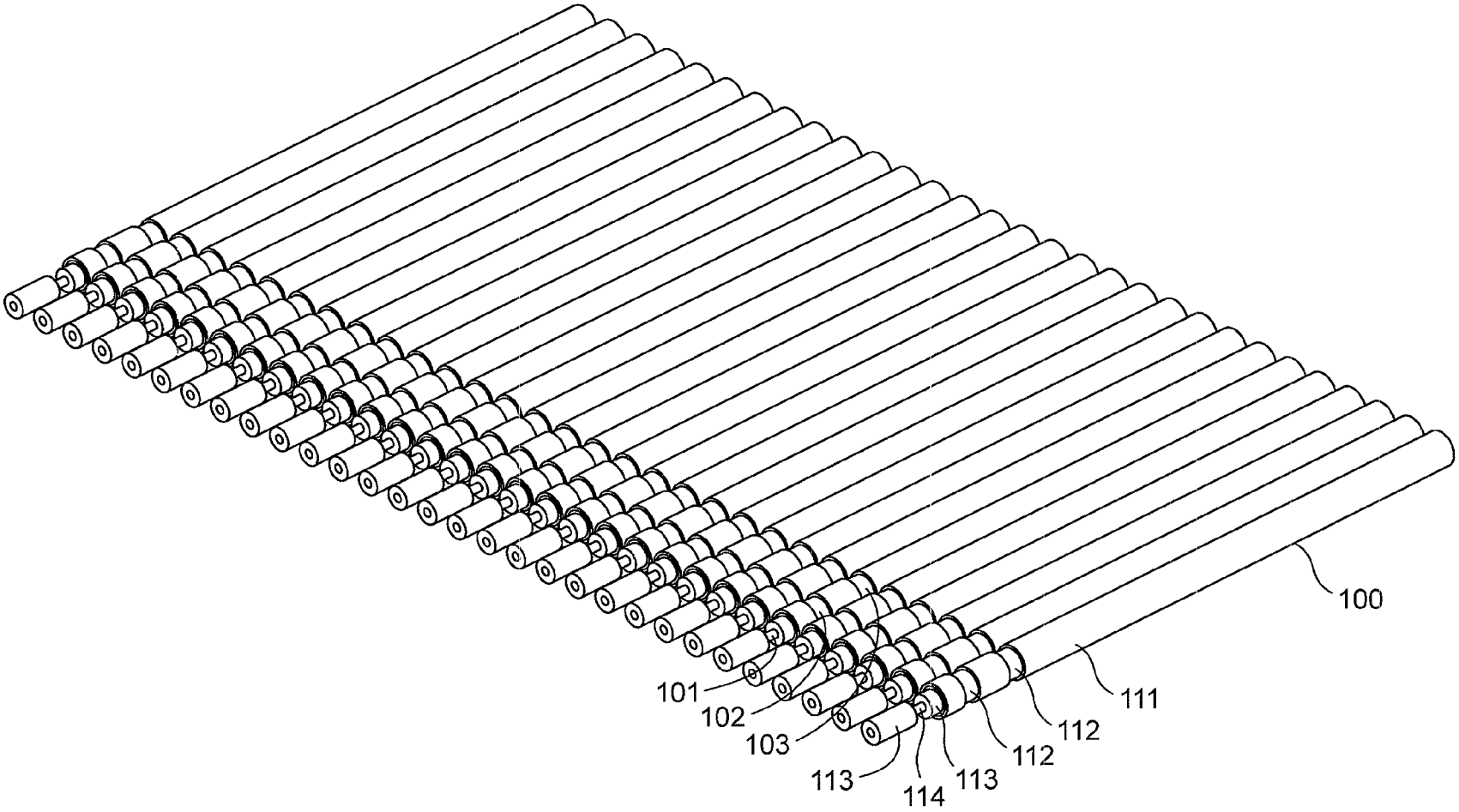
FIG. 6 is a perspective view of coaxial cables arranged in parallel.
Figure 12:
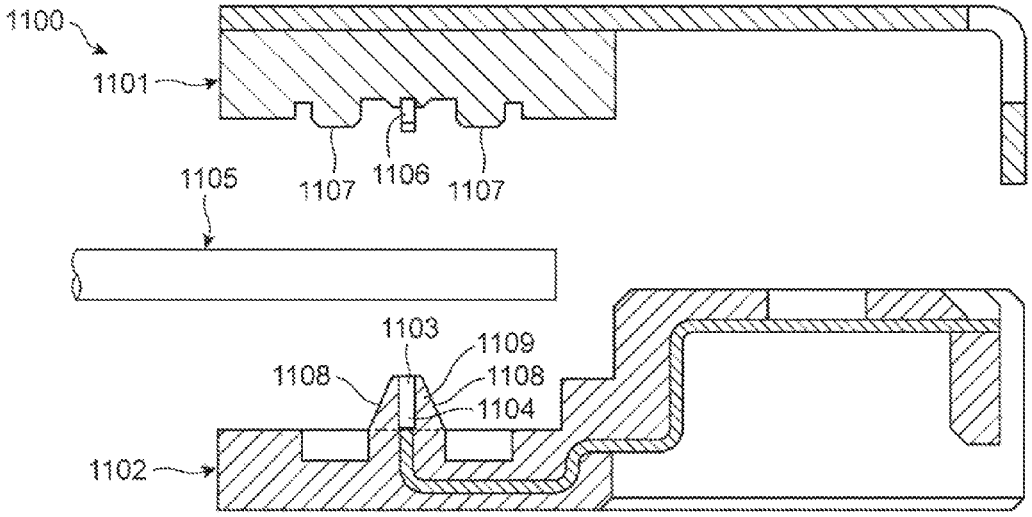
FIG. 12 PRIOR ART
FIG. 12 is a cross-sectional view of the conventional connector (receptacle type connector).
Figure 13A:
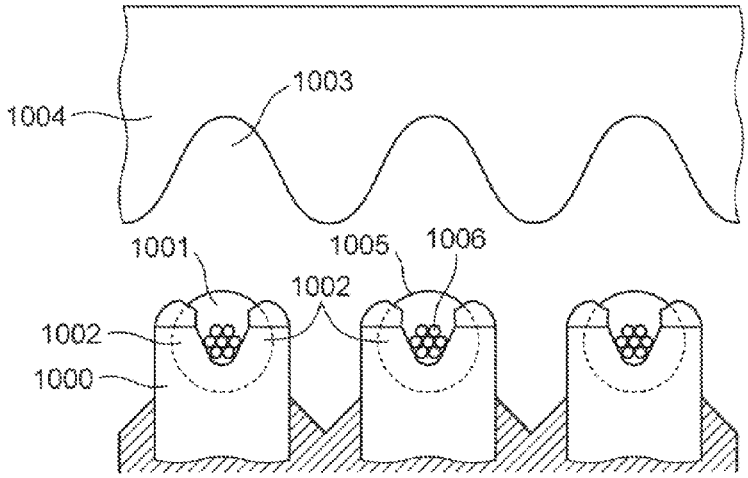
FIG. 13A PRIOR ART
FIG. 13A is a front view of another conventional connector together with a punching unit.
Figure 13B:
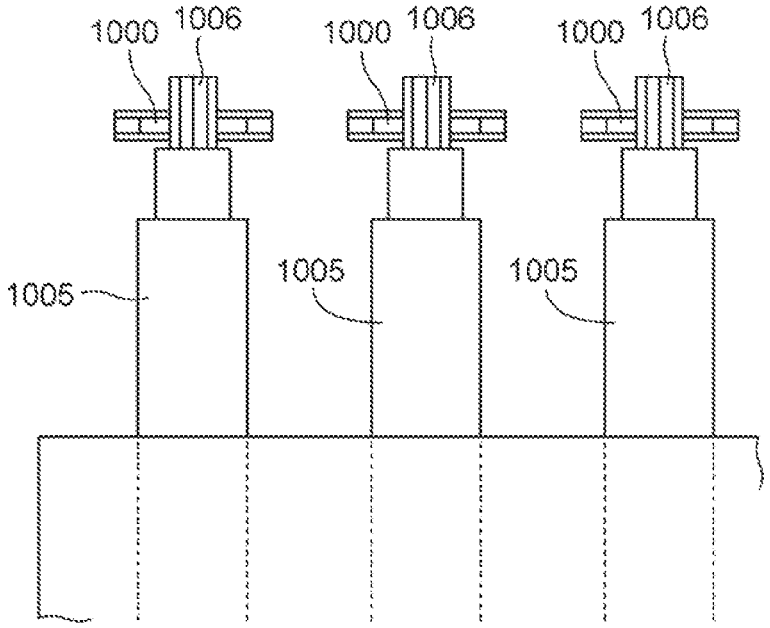
FIG. 13B PRIOR ART
FIG. 13B is a plan view of the contact illustrated in FIG. 13A, to which a cable is connected.
Figure 13C:
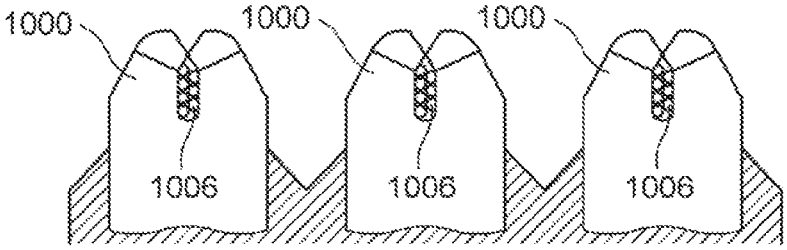
FIG. 13C PRIOR ART
FIG. 13C is a front view of the contact illustrated in FIG. 13A, showing that the contact holds core wires after compressed by the punching unit.
Figure 13D:
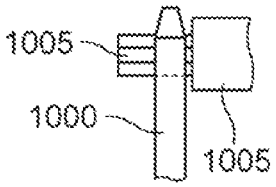
FIG. 13D PRIOR ART
FIG. 13D is a partial side view of FIG. 13A.

As illustrated in FIG. 6, there is prepared a plurality of the coaxial cables 100. As the coaxial cable 100, there may be used a cable AWG28 including seven core wires (central electrical conductors) each having a diameter of 0.127 mm, and having an outer diameter (including an outer cover) of about 0.5 mm, as used in the electric connector 1100 illustrated in FIG. 12. As an alternative, there may be used a thinner coaxial cable as the coaxial cable 100.

First, an external insulative cover 111 (an outermost cover) and the external electrical conductor 112 surrounded by the external insulative cover 111 are peeled off from an end (a left end in FIG. 6) to a position at which the coaxial cable 100 makes contact with the first terminal 400 to thereby cause an internal insulative cover 113 surrounding the central electrical conductor 114 to be exposed. Then, the internal insulative cover 113 is peeled off at a location at which the coaxial cable 100 makes contact with the first terminal 400 to thereby cause the central electrical conductor 114 to be exposed. The exposed portion of the central electrical conductor 114 defines a first contact 101 through which the coaxial cable 100 makes contact with the first terminal 400.

Then, an external insulative cover 111 is peeled off the coaxial cable 100 to thereby cause the external electrical conductor 112 surrounding the internal insulative cover 113 to be exposed in line with the second support 401 and the third support 402 both positioned at the first position. Furthermore, the external insulative cover 111 is peeled off the coaxial cable 100 to thereby cause the external electrical conductor 112 to be exposed in line with the second support 401 and the third support 402 both positioned at the second position. The external insulative cover 111 is peeled off in all of the coaxial cables 100 to thereby cause the external electrical conductor 112 to be exposed.

A portion of the coaxial cable 100 at which the external electrical conductor 112 is exposed at the first position defines a second contact 102 through which the coaxial cable 100 makes contact with the second support 401 and the third support 402, and a portion of the coaxial cable 100 at which the external electrical conductor 112 is exposed at the second position defines a third contact 103 through which the coaxial cable 100 makes contact with the second support 401 and the third support 402.

Figure 7:
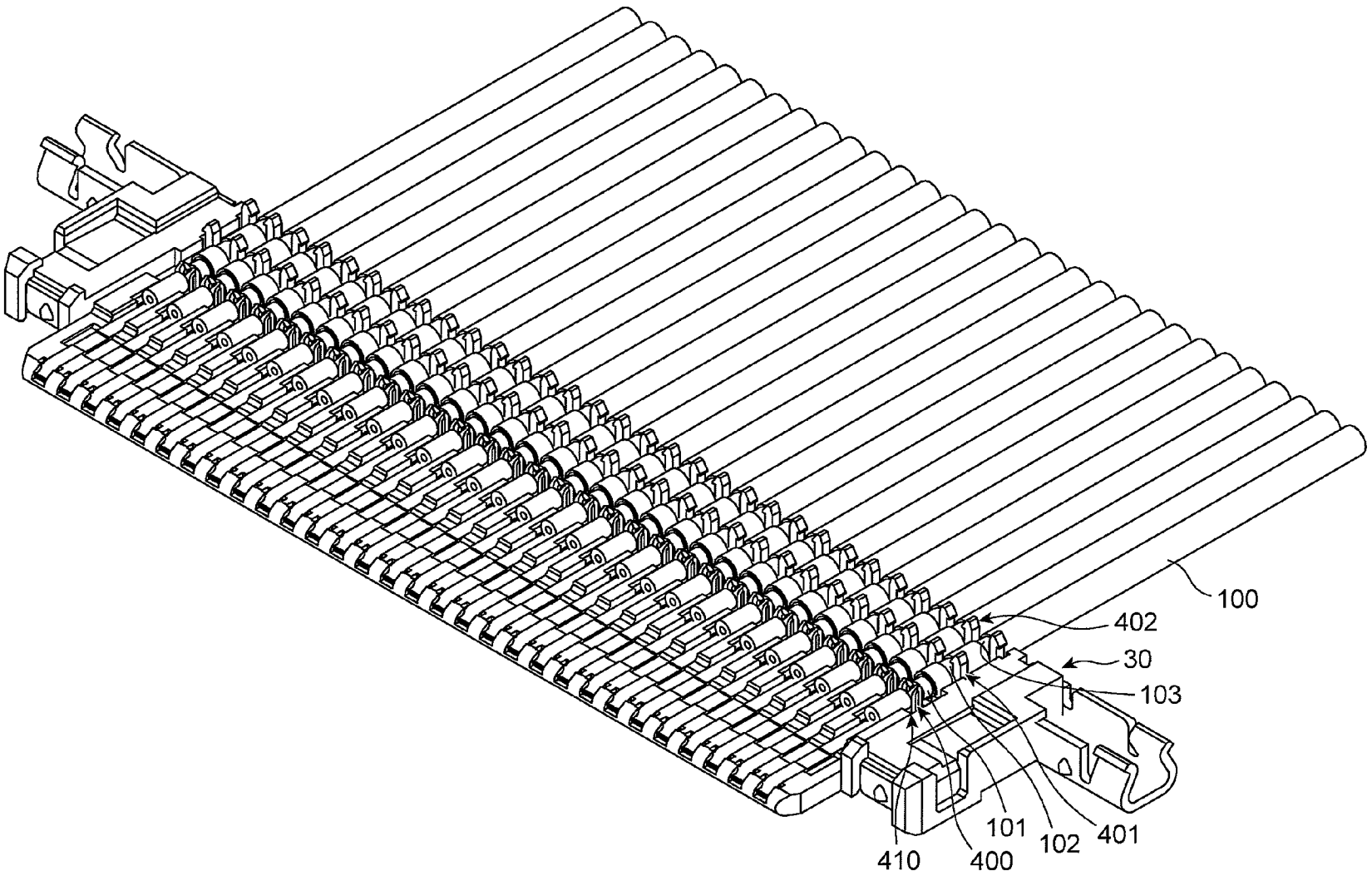
FIG. 7 is a perspective view of the housing (FIG. 2) in which the coaxial cables (FIG. 6) are arranged.
Figure 8:
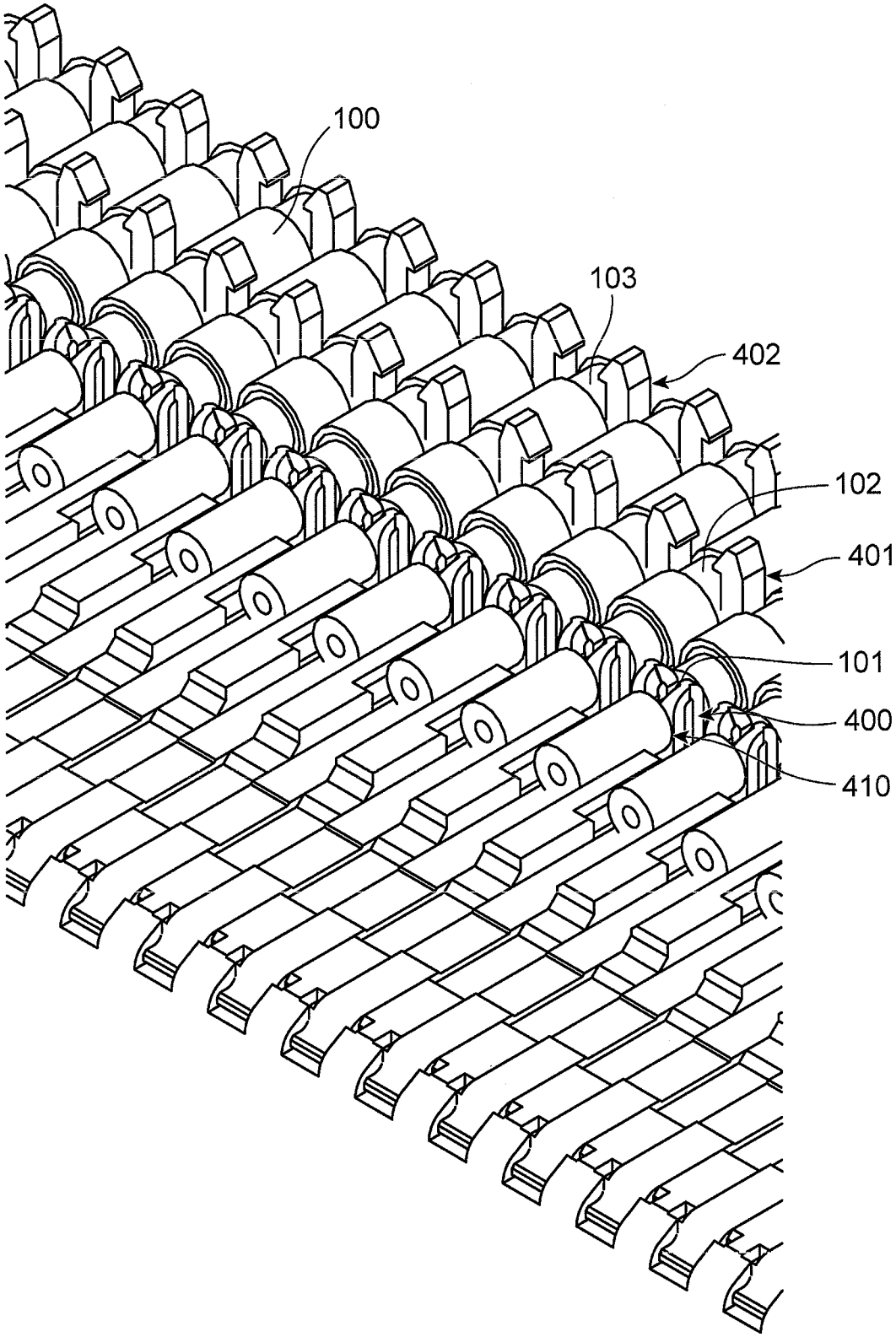
FIG. 8 is a partially enlarged view of FIG. 7.

Then, the coaxial cables 100 are arranged in the housing 30 in such a way as illustrated in FIGS. 7 and 8. Further, the first contact 101 at which the central electrical conductor 114 is exposed is inserted into the first and second slits 451 and 452 of the first terminal 400, and the second contact 102 and the third contact 103 at both of which the external electrical conductor 112 is exposed are inserted into the second support 401 and the third support 402.

Since the first and second slits 451 and 452 are V-shaped at upper ends thereof, even if the first and second slits 451 and 452 have a width smaller than an outer diameter of the central electrical conductor (core wire) 114, the central electrical conductor 114 can be readily inserted into the first and second slits 451 and 452.

In addition, since the first and second slits 451 and 452 are designed to have a width smaller than an outer diameter of the central electrical conductor 114, the central electrical conductor 114 having been pushed into the first and second slits 451 and 452 can be kept in the first and second slits 451 and 452 by virtue of the elastic reaction force exerted by the first portion 420 and the second portion 430.

Figure 14A:
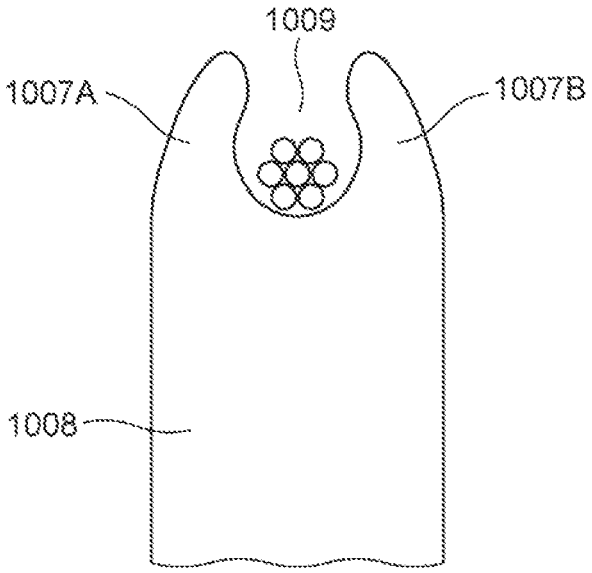
FIG. 14A PRIOR ART
FIG. 14A is a front view of another conventional contact.
Figure 14B:
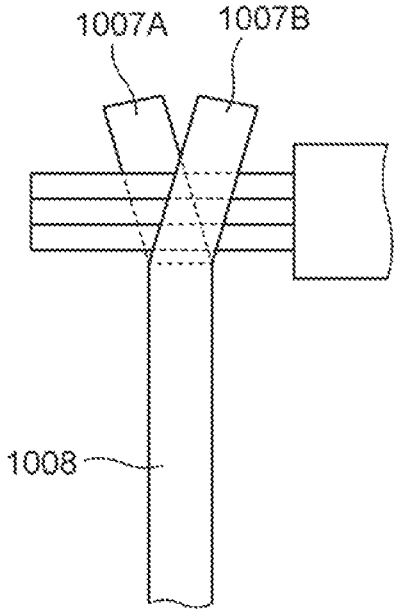
FIG. 14B PRIOR ART
FIG. 14B is a side view of the contact illustrated in FIG. 14A.
Figure 14C:
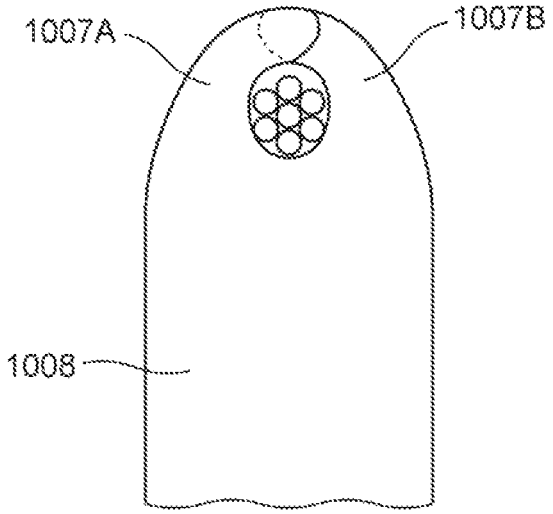
FIG. 14C PRIOR ART
FIG. 14C is a front view of the contact illustrated in FIG. 14A, showing that the contact holds cables.

Accordingly, compared to the contact 1008 illustrated in FIGS. 14A to 14C in which the compression terminals 1007A and 1007B are elastically deformed at their distal ends to thereby hold core wires therein, the first terminal 400 capable of keeping the central electrical conductors 114 in the first and second slits 451 and 452 by virtue of the elastic reaction force exerted by the first portion 420 and the second portion 430 ensures stable electrical connection between the first terminal 400 and the coaxial cable 100.

FIG. 9 illustrates a positional relation among the central electrical conductors 114, the first slit 451, the second slit 452 and the cable space 32.

In FIG. 9, "LL" indicates an axis of the coaxial cable 100 held by the second support 401 and the third support 402, "1P" indicates a center line of the first slit 451, "2P" indicates a center line of the second slit 452, and "3P" indicates a center line of the cable space 32 in which a portion of the coaxial cable 100 beyond the support unit 410 is accommodated.

As illustrated in FIG. 9, the center line 1P of the first slit 451 is deviated to the right in FIG. 9 relative to the axis LL of the coaxial cable 100 held by the second support 401 and the third support 402. Accordingly, the coaxial cable 100 held by the second support 401 and the third support 402 is held in a condition of being deviated or bent to the right, by being inserted into the first slit 451.

As illustrated in FIG. 9, the center line 2P of the second slit 452 is deviated to the left in FIG. 9 relative to the axis LL of the coaxial cable 100. Accordingly, the central electrical conductors 114 of the coaxial cable 100 inserted into the first slit 451 and further into the second slit 452 is held in a condition of being deviated from the center line 1P towards the center line 2P. Specifically, an axis of the central electrical conductors 114 is gradually shifted from the center line 1P to the center line 2P in accordance with a direction in which the third portion 440 is inclined. The axis of the central electrical conductors 114 is located at the center line 1P at the first slit 451, and at the center line 2P at the second slit 452.

As illustrated in FIG. 9, the center line 3P of the cable space 32 is deviated to the right in FIG. 9 relative to the axis LL of the coaxial cable 100.

Accordingly, the axis of the central electrical conductor 114 is shifted to the center line 3P from the center line 2P by being inserted into the cable space 32.

As mentioned above, the coaxial cable 100 is held by the second support 401 and the third support 402, and is kept in the cable space 32 such that the axis of the central electrical conductor 114 of the coaxial cable 100 is bent in zigzag, as shown with a two-dot chain line 1L in FIG. 9.

The support unit 410 sandwiches the central electrical conductor 114 therein in the above-mentioned manner such that the support unit 410 exerts a contact pressure on the bent axis LL of the exposed central electrical conductor 114. Thus, even if the central electrical conductor 114 is comprised of a bundle of thin wires, it is possible to surely hold the central electrical conductor 114 with the central electrical conductor 114 being kept in the form of a bundle, ensuring enhancement in reliability to the electrical connection between the electric connector 10 and the central electrical conductor 114 or the coaxial cable 100.

Since the center line 1P of the first portion 420 is deviated to the right relative to the axis LL of the coaxial cable 100 supported by the second and third supports 401 and 402, the axis LL is bent to the right by the first portion 420. Furthermore, since the center line 2P of the second portion 430 is deviated to the left relative to the axis LL of the coaxial cable 100, the axis is bent to the left by the second portion 430. Thus, the support unit 410 can make close contact with the central electrical conductor 114.

Since the third portion 440 is located between the first portion 420 and the second portion 430, the central electrical conductor 114 is bent from the center line 1P to the center line 2P in accordance with the inclination of the third portion 440, ensuring it possible to release the stress acting on the central electrical conductor 114 due to being bent a plurality of times.

Furthermore, since the center line 3P of the cable space 32 in which the coaxial cable 100 is housed beyond the second portion 430 is deviated to the right relative to the axis LL of the coaxial cable 100, the central electrical conductor 114 having been bent to the left by the second portion 430 is further bent to the right by the cable space 32, ensuring that the second portion 430 can make close contact with the central electrical conductor 114.

Since the first and second portions 420 and 430 are connected at upper ends thereof with each other, it is possible to keep the positional relation between the first and second portions 420 and 430 both bending the axis LL of the central electrical conductor 114 in accordance with the center lines 1P and 2P, when the central electrical conductor 114 is inserted into the first slit 451 and the second slit 452.

Second Embodiment

Figure 10:
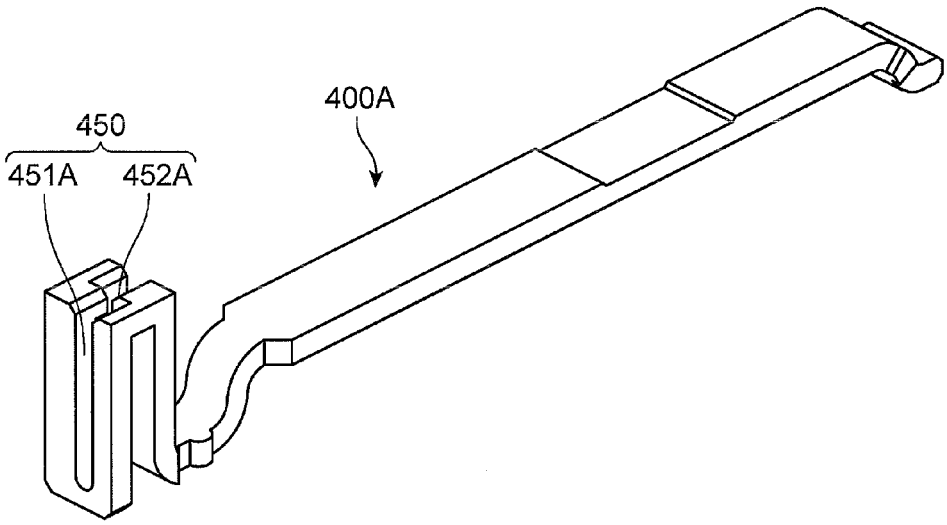
FIG. 10 is a perspective view of the first terminal to be used in the electric connector in accordance with the second embodiment of the present invention.
Figure 11:
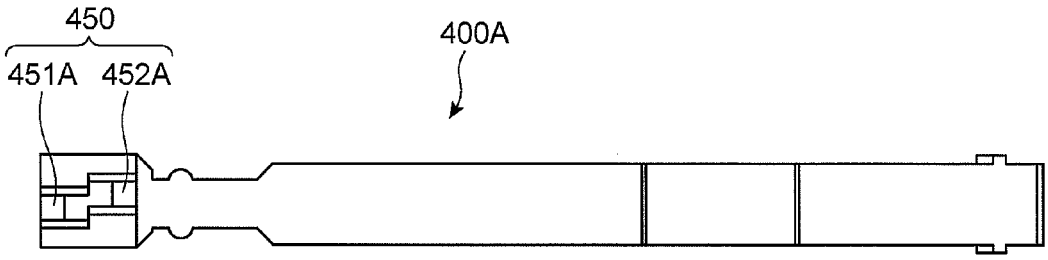
FIG. 11 is a plan view of the first terminal illustrated in FIG. 10.

FIG. 10 is a perspective view of the first terminal 400A to be used in the electric connector in accordance with the second embodiment of the present invention, and FIG. 11 is a plan view of the first terminal 400A.

The electric connector in accordance with the second embodiment is designed to use the first terminal 400A in place of the first terminal 400 used in the first embodiment. The electric connector in accordance with the second embodiment is designed to have the same structure as that of the electric connector 10 in accordance with the first embodiment except using the first terminal 400A in place of the first terminal 400.

In the electric connector 10 in accordance with the first embodiment, a relative position of the first slit 451 relative to the first portion 420 and a relative position of the second slit 452 relative to the second portion 430 are identical with each other, however, when viewed in a direction of the axis LL of the central electrical conductor 114 of the coaxial cable 100, the first portion 420 and the second portion 430 deviate in position from each other. Thus, a center line of the first slit 451 and a center line of the second slit 452 deviate from each other.

In contrast, in the electric connector in accordance with the second embodiment, a relative position of the first slit 451 relative to the first portion 420 and a relative position of the second slit 452 relative to the second portion 430 are designed to be different from each other, so that a center line of the first slit 451 and a center line of the second slit 452 deviate from each other.

Specifically, as illustrated in FIG. 11, the first and second slits 451 and 452 in the second embodiment are configured such that a center line 451A of the first slit 451 (a center line extending in parallel with the axis LL of the coaxial cable 100) and a center line 452A of the second slit 452 (a center line extending in parallel with the axis LL of the coaxial cable 100) are designed to deviate from each other when viewed in a direction of the axis LL of the coaxial cable 100.

Since the center line 451A of the first slit 451 and the center line 452A of the second slit 452 are designed to originally deviate from each other, it is no longer necessary to form the first and second portions 420 and 430 such that they deviate from each other, in other words, it is no longer necessary to form the third portion 440, unlike the first embodiment.

The second embodiment using the first terminal 400A in place of the first terminal 400 provides the same advantages as that of the electric connector 10 in accordance with the first embodiment.

As a cable to be connected to the electric connector in the first and second embodiments, the coaxial cable 100 including the central electrical conductor comprised of a bundle of thin wires is used. It should be noted that a coaxial cable including a central electrical conductor comprised of a single wire, a one-wire cable including no external electrical conductor, or a twisted-wire cable may be used in place of the coaxial cable 100.

INDUSTRIAL APPLICABILITY

The electric connector in accordance with the present invention is suitable as a connector to be employed in various fields such as an automobile industry, an electric/electronic device industry and various mechanical industries, as a device to be connected to a cable for transmitting/receiving electric signals.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

The entire disclosure of Japanese Patent Application No. 2013-214959 filed on Oct. 15, 2013 including specification, claims, drawings and summary is incorporated herein by reference in its entirety.

What is claimed is:

1. A terminal made of a single metal sheet, said terminal comprising a support unit in which a core wire of a cable is sandwiched, said support unit including:

a first portion extending in a direction perpendicular to a longitudinal axis of said core wire;

a second portion spaced apart from said first portion, and extending in the direction perpendicular to said longitudinal axis of said core wire, and a third portion connecting said first portion and said second portion to each other, said third portion being laterally inclined relative to said longitudinal axis of said core wire, wherein said first portion and said second portion are connected at an end thereof to each other, wherein each of said first portion and said second portion has a slit formed therethrough, wherein a center line of said slit of said first portion and a center line of said slit of said second portion are offset from each other when viewed in a direction of said longitudinal axis of said core wire, wherein a position of said slit in said first portion relative to said first portion and a position of said slit in said second portion relative to said second portion are identical with each other, and said first portion and said second portion are offset from each other when viewed in the direction of said longitudinal axis of said core wire.

2. An electric connector comprising:

a first terminal made of a single metal sheet and including a support unit in which a core wire of a cable is sandwiched, said support unit including:

a first portion extending in a direction perpendicular to a longitudinal axis of said core wire; and a second portion spaced apart from said first portion, and extending in the direction perpendicular to said longitudinal axis of said core wire, wherein said first portion and said second portion are connected at an end thereof to each other, wherein each of said first portion and said second portion has a slit formed therethrough, and wherein a center line of said slit of said first portion and a center line of said slit of said second portion are offset from each other when viewed in a direction of said longitudinal axis of said core wire; and a housing including a second support and a third support, wherein said second support and said third support are spaced apart from each other in a direction of said longitudinal axis of said core wire, and wherein said second support said cable at a first side of said cable and said third support said cable at a second side of said cable in the direction perpendicular to said longitudinal axis of said core wire; an external electrical conductor surrounding an internal insulative cover is exposed in line with the second support.

3. The terminal as set forth in claim 2, wherein a position of said slit in said first portion relative to said first portion and a position of said slit in said second portion relative to said second portion are identical with each other, and said first portion and said second portion are offset from each other when viewed in the direction of said longitudinal axis of said core wire.

4. The terminal as set forth in claim 3, wherein said support unit further includes a third portion connecting said first portion and said second portion to each other, said third portion being laterally inclined relative to said longitudinal axis of said core wire.

5. The terminal as set forth in claim 1, wherein said slit in said first portion and said slit in said second portion are V-shaped or U-shaped at an end whereat said first portion and said second portion are connected to each other.

6. The terminal as set forth in claim 1, wherein each of said slit in said first portion and said slit in said second portion has a width smaller than a width of said core wire.

7. The terminal as set forth in claim 1, further comprising a terminal part in the form of a plate, said terminal plate extending from a free end of one of said first portion or said second portion in the direction of said longitudinal axis of said core wire.

8. The terminal as set forth in claim 1, wherein each of said first portion and said second is U-shaped when viewed in the direction perpendicular to said longitudinal axis of said core wire.

9. The terminal as set forth in claim 2, wherein a position of said slit in said first portion relative to said first portion and a position of said slit in said second portion relative to said second portion are different from each other such that center lines of said slit of said first portion and said slit of said second portion are offset from each other when viewed in the direction of said longitudinal axis of said core wire.

10. The electric connector as set forth in claim 2, wherein said cable is comprised of a coaxial cable, wherein said first terminal supports and makes electrical contact with said core wire of said cable, and wherein said second support and said third support said cable through the external electrical conductor surrounding the internal insulative cover covering therewith said core wire of said cable.

11. The electric connector as set forth in claim 2, further including a cable space in which said cable is accommodated, said cable space being located at an opposite side relative to said second support and said third support about said first terminal, said cable space having a center line extending in the direction of said longitudinal axis of said core wire, and said center line being offset from said longitudinal axis of said core wire.

* * * * *